US005617694A

United States Patent [19]

Baba

[11] Patent Number: 5,617,694

[45] Date of Patent: Apr. 8, 1997

[54] BEAM OR GIRDER JOINT ELEMENT

[75] Inventor: Eihachiro Baba, Tokyo, Japan

[73] Assignee: Kabushiki Kaisha Kenchiku Shiryo Kenkyusha, Tokyo, Japan

[21] Appl. No.: 429,136

[22] Filed: Apr. 26, 1995

[30] Foreign Application Priority Data

Apr. 27, 1994 [JP] Japan ..... 6-112316

[51] Int. Cl.[6] ..... E04B 1/38

[52] U.S. Cl. ..... 52/712; 52/236.3; 52/656.9; 403/174; 403/217; 403/407.1

[58] Field of Search ..... 52/726.2, 737.2, 52/712, 702, 667, 656.9, 714, 715, 236.3, 665; 403/12, 230, 245, 405.1, 170, 174, 205, 217, 218, 219, 231, 403, 407.1; 256/65

[56] References Cited

U.S. PATENT DOCUMENTS

| | | | |
|---|---|---|---|
| 574,434 | 1/1897 | Keithley | 52/236.3 |
| 834,462 | 10/1906 | Faught | 403/217 |
| 3,427,055 | 2/1969 | Jureit et al. | 403/231 |
| 3,846,031 | 11/1974 | Adams | 52/726.2 X |
| 4,299,509 | 11/1981 | Meickl | 403/174 |
| 4,920,713 | 5/1990 | Borresen et al. | 52/200 |
| 5,022,209 | 6/1991 | Kimura | 52/665 |
| 5,253,945 | 10/1993 | Hosokawa | 52/737.2 X |
| 5,295,754 | 3/1994 | Kato | 52/702 X |
| 5,438,811 | 8/1995 | Goya | 403/230 X |

*Primary Examiner*—Michael Safavi

*Attorney, Agent, or Firm*—Sixbey, Friedman, Leedom & Ferguson; Gerald J. Ferguson, Jr.; Karlton C. Butts

[57] ABSTRACT

A beam or girder joint element is formed by a flat plate member composed of: (a) column connecting plate portion having a plurality of pin receiving holes and a vertical slit; and (b) a beam or girder connecting plate portion formed as a unitary structure with the column connecting plate portion on at least one side thereof and having a pin receiving hole, a plurality of bolt holes and a V-shaped guide groove defined by a slope extending down from the upper edge of the beam or girder connecting plate portion toward the column connecting plate portion and a vertical edge opposite to the slope.

6 Claims, 13 Drawing Sheets

BEAM OR GIRDER JOINT ELEMENT

BACKGROUND OF THE INVENTION

1. Field of the of the Invention

The present invention relates to a beam or girder joint element for joining or fastening a beam or girder to a column.

2. Prior Art

There has been proposed such a beam or girder joint element as shown in FIG. 15, which is formed by a plate member 1 of a T-shaped cross-section. The plate member 1, which is made of metal, is composed of a square column connecting plate portion 2 and a square beam or girder connecting plate portion 4 extending therefrom perpendicularly thereto. The column connecting plate portion 2 has a length $W_2$ in the lateral direction, a length $H_2$ in the vertical direction and a thickness $D_2$; the plate portion 2 has, for example, four bolt holes 3. The beam or girder connecting plate portion 4 has a length $W_4$ in the lateral direction, a length $H_4$ equal to that $H_2$ of the plate portion 2 in the vertical direction and a thickness $D_4$; the plate portion 4 has, for example, two bolt holes 5. Reference numerals **2*a* and 2*b* denote front and rear surfaces of the column connecting plate portion 2**.

In this case, the four bolt holes 3 of the column connecting plate portion 2 are arranged in pairs one above the other in right and left halves of the plate portion 2, and the two bolt holes 5 of the beam or girder connecting plate portion 4 are also arranged one above the other.

As described below with reference to FIGS. 16 and 17, it is possible, with such a conventional beam or girder joint element, to fasten or join a girder or beam 20 to a column 10 by means of bolts 31, nuts 32 and washers 33 and bolts 41, nuts 42 and washers 43.

The column 10, which is normally made of wood, is square in cross-section; left- and right-hand sides 10L and 10R of the column 10 each have a width $W_{10}$ substantially equal to or larger than the length $W_2$ of the column connecting plate portion 2 of the plate member 1 forming the beam or girder joint element. The column 10 has four bolt holes 13 which extend between the left- and right-hand sides 10L and 10R, corresponding to the four bolt holes 3 of the column connecting plate portion 2, respectively. Furthermore, the column 10 has a clearance groove 12 cut in its right-hand side 10R so that the column connecting plate portion 2 of the plate member 1, the tips of the bolts 31 and their nuts 32 and washers 33 do not protrude from the right-hand side 10R when the plate member 1 is attached to the column 10 as described later.

The beam or girder 20, which is also normally made of wood, has a left-hand end face 20LF corresponding to the right-hand side 10R of the column 10 and is square in cross-section. The beam or girder 20 has a groove 24 which has a width $D_{24}$ nearly equal to the thickness D4 of the beam or girder connecting plate portion 4 of the plate member 1 and a length $L_{24}$ nearly equal to or slightly larger than the length $W_4$ of the plate portion 4 and which extends vertically between the top 20U and bottom 20D of the beam or girder 20 and extends laterally to the left-hand end face 20LE. Furthermore, the beam or girder 20 has to bolt holes 25 which are nearly equal in diameter to the bolt holes 5 of the beam or girder connecting plate portion 4 of the plate member 1 and extend between the front 20F and back 20B of the beam or girder 20 across the above-mentioned groove 24.

The bolts 31 are headed ones corresponding to the bolt holes 3 of the column connecting plate portion 2 of the plate member 1 and the bolt holes 13 of the column 10, and the nuts 32 are hexagonal.

The bolts 41 are also headed ones corresponding to the bolt holes 5 of the beam or girder connecting plate portion 2 of the plate member 1 and the bolt holes 25 of the beam or girder 20, and nuts 42 are hexagonal.

The beam or girder 20 is fastened or joined to the column 10 by means of the bolts 31 and their nuts 32 and washers 33 and the bolts 41 and their nuts 42 and washers 43 in such a fashion as described below.

At first, the plate member 1, which forms the beam or girder joint element, is held against the right-hand side 10R of the column 10 with the column connecting plate portion 2 received in the clearance groove 12 of the column 10, then the bolts 31 with the washers 33 put thereon are inserted through the bolt holes 13 of the column 10 from the left-hand side 10L thereof, then the remaining washers 33 are put on the free ends of the bolts 31, and the nuts 32 are thread-mounted on the projecting ends of the bolts 31 and tightened toward the column 10. In this way, the plate member 1 is fastened to the column 10.

Next, the beam or girder 20 is held against the right-hand side of the column 10, with the groove 24 receiving the beam or girder connecting plate portion 4 of the plate member 1 and the left-hand end face 20LE abutting against the right-hand side 10R of the column 10, then the bolts 41 with the washers 43 put thereon are inserted through the bolt holes 25 of the beam or girder 20 across the bolt holes 5 of the beam or girder connecting plate portion 4 of the plate member 1, then the remaining washers 44 are put on the free ends of the bolts 41 and the nuts 42 are thread-mounted on the projecting ends of the bolts 41 and tightened to the beam or girder 20. In this way, the beam or girder 20 is fixed to the beam or girder connecting plate portion 4 of the plate member 1 and consequently to the column 10.

As described above, it is possible, with the conventional beam or girder joint element of FIG. 15, to secure the beam or girder 20 to a desired side of the column 10 (the right-hand side 10R in the above).

However, the conventional beam or girder joint element cannot firmly be fixed to the column 10 because the column connecting plate portion 2 of the plate member 1 is secured by the bolts 31 alone.

The conventional beam or girder joint element calls for the provision of the clearance groove 12 in the desired side of the column 10 so that the column connecting plate portion 2 of the plate member 1, the free end portions of the bolts 31 and their nuts 32 and washers 33 do not protrude from the side surface of the column 10 when the plate member 1 is fixed thereto. The clearance groove 12 needs to be large and deep enough to receive the column connecting plate portion 2 of the plate member 1—this naturally reduces the strength of the column 10.

The conventional beam or girder joint element has another defect that the beam or girder 20 must be supported from below when inserting the bolts 41 through the bolt holes 25 of the beam or girder connecting plate portion 4 of the plate member 1 and thread-mounting the nuts 42 on the free ends of the bolts 41 while holding the left-hand end face 20LE of the beam or girder 20 against the specified side of the column 10 after fixing the plate member 1 thereto—this is very cumbersome.

SUMMARY OF THE INVENTION

It is therefore an object of the present invention to provide a novel beam or girder joint element free from the above-mentioned defects of the prior art.

According to a first aspect of the present invention, the beam or girder joint element is formed by a flat plate member which comprises: (a) a square column connecting plate portion which has a plurality of pin receiving through holes and a vertically extending slit; and (b) a beam or girder connecting plate portion which is formed as a unitary structure with the column connecting plate portion and extended therefrom along its right- or left-hand marginal edge and has a pin receiving through hole, a plurality of bolt holes and a V-shaped guide groove defined by a slope extending down from the upper edge of the beam or girder connecting plate portion toward the column connecting plate portion and a vertical edge opposite to the slope.

According to a second aspect of the present invention, in the beam or girder joint element of the first aspect, the column connecting plate portion of the plate member is longer than the beam or girder connecting plate portion in the vertical direction and the slit of the column connecting plate portion has a length nearly equal to the left- or right-hand end face of the beam or girder connecting plate portion.

According to a third aspect of the present invention, in the beam or girder joint element of the first aspect, the column connecting plate portion of the plate member has about the same vertical length as does the beam or girder connecting plate portion.

According to a fourth aspect of the present invention, the beam or girder element is formed by a plate member which comprises: (a) a square column connecting plate portion which has a plurality of pin receiving through holes and a vertically extending slit; (b) a left beam or girder connecting plate portion which is formed as a unitary structure with the column connecting plate portion and extended therefrom along its left-hand marginal edge and has a pin receiving through hole, a plurality of bolt holes and a V-shaped let guide groove defined by a slope extending down from the upper edge of the left beam or girder connecting plate portion and a vertical edge opposite to the slope; and (c) a fight beam or girder connecting plate portion which is formed as a unitary structure with the column connecting plate portion and extended therefrom along its right-hand marginal edge and has a pin receiving through hole, a plurality of bolt holes and a V-shaped right guide groove defined by a slope extending down from the upper edge of the right beam or girder connecting plate portion toward the column connecting plate portion and a vertical edge opposite to the slope.

According to a fifth aspect of the present invention, in the beam or girder joint element of the fourth aspect, the column connecting plate portion of the plate member is longer than the left and right beam or girder connecting plate members in the vertical direction; the left and fight beam or girder connecting plate portions are symmetrical with respect to the column connecting plate portion; and the slit of the column connecting plate portion has a length substantially equal to the left-hand end face of the left beam or girder connecting plate portion and the right-hand end face of the right beam or girder connecting plate portion.

According to a sixth aspect of the present invention, in the beam or girder joint element of the fourth aspect, the column connecting plate portion of the plate member has a vertical length equal to those of the left and right beam or girder connecting plate portions; the let and right beam or girder connecting plate portions are symmetrical with respect to the column connecting plate portion.

DESCRIPTION OF THE PREFERRED EMBODIMENT

EMBODIMENTS 1 to 4

Figure 1:
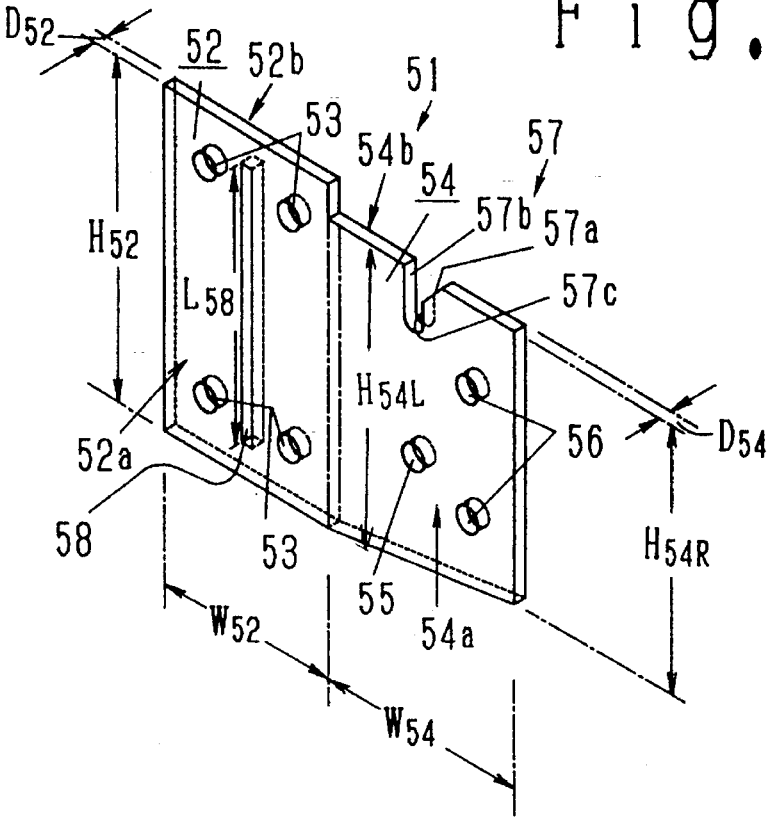
FIG. 1 is a schematic perspective view illustrating a first embodiment of the beam or girder joint element according to the present invention.

Referring now to FIGS. 1 to 4, first to fourth embodiments of the beam or girder joint element according to the present invention will be described.

The beam or girder joint elements of the first to fourth embodiments of the present invention are each formed by a fiat plate member 51 which is made of metal and composed of: (a) a square column connecting plate portion 52 which has a width $W_{52}$, a height $H_{52}$ and a thickness $D_{52}$ and has, for example, four pin receiving holes 53 and a vertical slit 58 of a length $L_{58}$ smaller than the height $H_{52}$ of the first plate portion 52; and (b) a square beam or girder connecting square plate portion 54 which is formed as a unitary structure with the column connecting plate portion and extended, for example, from the right-hand marginal thereof in FIGS. 1 to 4 and which has a width $W_{54}$ and a thickness $D_{54}$ equal to that $D_{52}$ of the column connecting plate portion 52 and has, for example, one pin receiving through hole 55, a plurality of, for example, two bolt holes 56 and a V-shaped guide groove 57 defined by a slope 57*a* extending down from the upper edge of the beam or girder connecting plate portion toward the column connecting plate portion 52 itself, a short vertical edge 57*c* contiguous to the lower end of the slope 57*a* and a vertical edge 57*b* opposite to them. Reference numerals 52*a* and 52*b*, 54*a* and 54*b* denote front and rear surfaces of the column connecting plate portion 52, and 54, respectively.

In the first to fourth embodiments of FIGS. 1 to 4, the slit 58 of the column connecting plate portion 52 is formed centrally thereof in the lateral direction and the four pin receiving holes 54 are formed in pairs one above the other at the positions corresponding to the upper and lower ends of the slit 58 in left and right halves of the column connecting plate portion 52.

Figure 2:
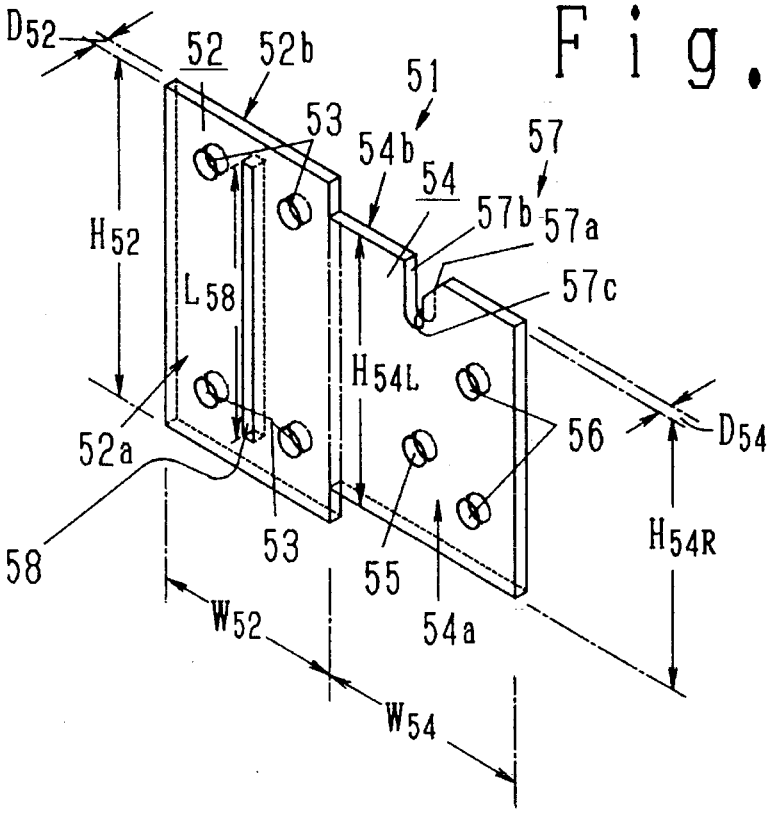
FIG. 2 is a schematic perspective view illustrating a second embodiment of the beam or girder joint element according to the present invention.
Figure 3:
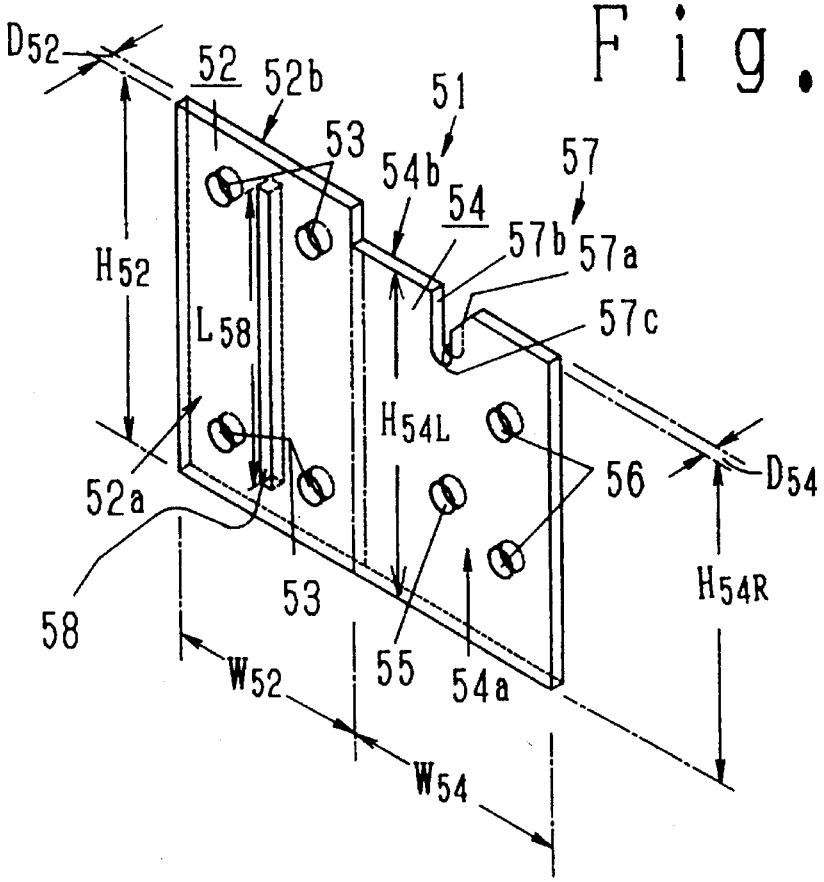
FIG. 3 is a schematic perspective view illustrating a third embodiment of the beam or girder joint element according to the present invention.

In the first to third embodiments of FIGS. 1 to 3, the left-hand marginal portion of the beam or girder connecting plate portion 54 contiguous to the column connecting plate portion 52 has a height $H_{54L}$ smaller than that $H_{52}$ of the latter; the right-hand marginal portion of the beam or girder connecting plate plate portion 54 on the opposite side from the column connecting plate portion 52 has a height $H_{54R}$ smaller than that $H_{52}$ of the column connecting plate portion and the upper marginal edge of the beam or girder connecting plate portion 54 horizontally extends to the right from the right-hand marginal edge of the column connecting plate portion 52 at a position a little below its upper edge.

In the FIG. 1 embodiment, the height $H_{54R}$ of the right-hand marginal edge of the beam or girder connecting portion 54 is smaller than the height $H_{54L}$ of the left-hand marginal edge. The lower marginal edge of the beam or girder connecting plate portion 54 extends obliquely upward to the right from the column connecting plate portion 52 at the position of the lower edge thereof.

In the FIG. 2 embodiment, the height $H_{54R}$ of the right-hand marginal edge of the beam or girder connecting plate portion 54 equal to the height $H_{54L}$ of the left-hand marginal edge. The lower edge of the beam or girder connecting plate portion 54 extends horizontally to the fight from the right-hand marginal edge of the column connecting plate portion 52 at a position a little above its lower end.

In the FIG. 3 embodiment, the height $H_{54R}$ of the right-hand marginal edge of the beam or girder connecting plate portion 54 equal to the height $H_{54L}$ of the left-hand marginal edge. The lower edge of the beam or girder connecting plate portion 54 extends horizontally to the right from the lower end of the right-hand marginal edge of the column connecting plate portion 52.

Figure 4:
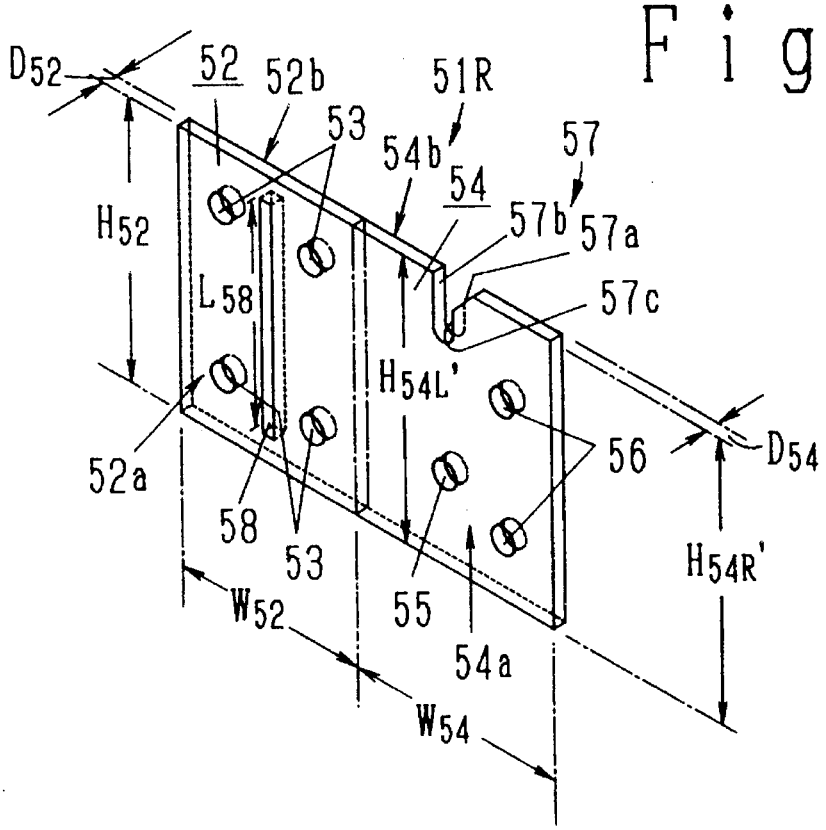
FIG. 4 is a schematic perspective view illustrating a fourth embodiment of the beam or girder joint element according to the present invention.

In the FIG. 4 embodiment, the left-hand marginal portion of the beam or girder connecting plate portion 54 has a height $H_{54L}'$ equal to that $H_{52}$ of the column connecting plate portion 52 and the right-hand marginal portion has a $H_{54R}'$ equal to that $H_{54L}'$ of the left-hand side marginal portion. The upper edge of the beam or girder connecting plate portion 54 extends horizontally to the fight from the upper end of the right-hand marginal portion of the column connecting plate portion 52; similarly, the lower edge of the plate portion 54 extends horizontally to the fight from the lower end of the right-hand marginal portion of the column connecting plate portion 52.

In the embodiments of FIGS. 1 to 4, the pin receiving hole 55 made in the beam or girder connecting plate portion 54 is disposed at a position substantially centrally thereof in the lateral direction and a little lower than the center thereof in the vertical direction; the bolt holes 56 are disposed at upper and lower positions substantially centrally of the right half of the beam or girder connecting portion 54 in the lateral direction. The guide groove 57 is formed substantially right above the pin receiving hole 55.

As described later with reference to FIGS. 9 to 11, the beam or girder joint elements of the first to fourth embodiments of the present invention (hereinafter referred to as joint elements A, for brevity's sake) can all be combined with a different beam or girder joint element (hereinafter referred to as a joint element B, for brevity's sake) to fasten beams 70R and 70F to a column 60 on the right side 60R and front 60F thereof, for example, by means of column connecting pin 81R and 81F, beam or girder connecting pins 91R and 91F, beam or girder clampling bolts 92R and 92F and their nuts 93R and 93F and washers 94R and 94F.

The beam or girder joint element B, which cm be used in combination with the joint elements A, is identical in construction with the joint elements A of the FIGS. 1 to 4 embodiments except that the slit 58 is omitted, the column connecting plate portion 52 and the beam or girder connecting plate portion 54 both have substantially the same height $H_5$ as the length $L_{58}$ of the vertical slit 58 and the upper and lower edges of the beam or girder connecting plate portion 54 extend horizontally from the upper and lower ends of the right-hand marginal edge of the column connection portion 52.

The above-mentioned column 60, which is normally made of wood, is square in cross-section; its front 60F and back 60B each have a width nearly equal to or greater than that $W_{52}$ of the column connecting plate portion 52 of the plate member 51 forming each of the joint elements A and left and right sides 60L and 60R of the column 60 each have a width nearly equal to or greater than that $W_{52}$ of the column connecting plate portion 52 of the plate member 51 of the joint element B. The column 60 has vertical grooves 61LR and 61FB. The vertical groove 61LR extends through the column 60 between its left and fight sides 60L and 60R and has a width substantially equal to the thickness $D_{52}$ of the column connecting plate portion 52 of the plate member 51 of the joint element A and a height substantially equal to or greater than that $H_{52}$ of the above-mentioned column connecting portion 52. The vertical groove 61FB similarly extends through the column 60 between the from 60F and back 60B of the column 60 and has a width substantially equal to the thickness $D_{52}$ of the column connecting plate portion 54 of the plate member 51 of the joint element B and a height substantially equal to or greater than that $H_5$ of the above-mentioned column connecting plate portion 52. Furthermore, the column 60 has four pin receiving holes 62FB corresponding to those 53 made in the column connecting plate portion 52 of the plate member 51 of the joint element. A and four pin receiving holes 62LR corresponding to those 53 made in the column connecting plate portion 52 of the joint element B. The four pin receiving holes 62FB have about the same diameters as those of the pin receiving holes 53 of the joint element A and extend across the above-mentioned vertical groove 61LR between the front 60F and back 60B of the column 60. The four pin receiving holes 62LR similarly have about the same diameters as those of the pin receiving holes 53 of the joint element B and extend across the above-mentioned vertical groove 61FB between the left and right sides 60L and 60R of the column 60.

In this instance, the positions of the four pin receiving holes 62FB on the column 60 defined with respect to the bottom of the vertical groove 61LR correspond to the positions of the pin receiving holes 53 on the column connecting plate portion 52 of the joint element A defined with respect to the lower edge of the plate portion 52. The positions of the four pin receiving holes 62LR on the column 60 defined with respect to the bottom of the vertical groove 61FB correspond to the positions of the pin receiving holes 53 on the column connecting plate portion 52 of the joint element B defined with respect to the lower edge of the column connecting plate portion 52.

The above-mentioned beam or girder 70R, which is also normally made of wood, has a left end face corresponding to the fight side 60R of the column 60 and is square in cross-section. The beam or girder 70R has a vertical groove 74R which extends between its top and bottom and meets its left-hand end face, a pin receiving-hole 75R which corresponds to that 55 made in the beam or girder connecting plate portion 54 of the joint element A, bolt holes 76R which correspond to those 56 made in the beam or girder connecting plate portion 54 of the joint element A, and a rod-like piece 77R for engagement with the guide groove 57 cut in the beam or girder connecting plate portion 54 of the joint element A. The vertical groove 74R has a width nearly equal to the thickness $D_{54}$ of the beam or girder connecting plate portion 54 of the joint element A and a height substantially equal to or slightly larger than the width $W_{54}$ thereof. The pin receiving hole 75R has about the same diameter as that of the pin receiving hole 55 made in the beam or girder connecting plate portion 54 of the joint element A and extends across the s vertical groove 74R between the front and back of the beam or girder 70R. The bolt holes 76R are substantially equal in diameter to those 56 made in the beam or girder connecting plate portion 54 of the joint element A and extend across the vertical groove 74R between the from and back of the beam or girder 70R. The rod-like piece 77R, which is normally made of metal, has a diameter such that it is snugly received in the guide groove 57; the rod-like piece 77R also extends across the vertical groove 74R between the from and back of the beam or girder 70R. In this instance, the positions of the pin receiving hole 75R and bolt holes 76R on the beam or girder 70R defined with respect to the engaging piece 77R correspond to the positions of the pin receiving hole 55 and the bolt holes 56 of the beam or girder connecting plate portion 54 of the joint element A on the plate portion 54 defined with respect to the bottom of the guide groove 57.

The above-mentioned beam or girder 70F, which is also normally made of wood, has a back end face corresponding to the front 60F of the column 60 and is square in cross-section. The beam or girder 70F has a vertical groove 74F which extends between its top and bottom and meets its back end face, a pin receiving hole 75F which corresponds to that 55 made in the beam or girder connecting plate portion 54 of the joint element B, bolt holes 76F which correspond to those 56 made in the beam or girder connecting plate portion 54 of the joint element B, and a rod-like piece 77F for engagement with the guide groove 57 cut in the beam or girder connecting plate portion 54 of the joint element B. The vertical groove 74F has a width nearly equal to the thickness $D_{54}$ of the beam or girder connecting plate portion 54 of the joint element B and a height substantially equal to or slightly larger than the width $W_{54}$ thereof. The pin receiving hole 75F has about the same diameter as that of the pin receiving hole 55 made in the beam or girder connecting plate portion 54 of the joint element B and extends across the vertical groove 74F between the left and right sides of the beam or girder 70F. The bolt holes 76F are substantially equal in diameter to those bolt holes 56 made in the beam or girder connecting plate portion 54 of the joint element B and extend across the vertical groove 74F between the left and fight sides of the beam or girder 70F. The rod-like piece 77F, which is also normally made of metal, has a diameter such that it is snugly received in the guide groove 57; the rod-like piece 77F also extends across the vertical groove 74F between the left and right sides of the beam or girder 70F. In this instance, the positions of the pin receiving hole 75F and bolt holes 76F on the beam or girder 70F defined with respect to the engaging piece 77F correspond to the positions of the pin receiving hole 55 and the bolt holes 56 of the beam or girder connecting plate portion 54 of the joint element B on the plate portion 54 defined with respect to the bottom of the guide groove 57.

The pins 81R and 81F, each of which is normally made of metal, correspond to the pin receiving holes 61LR and 61FB made in the column 60, respectively.

The pins 91R and 91F, each of which is also normally made of metal, correspond to the pin receiving holes 75R and 75F made in the beams or girders 70R and 70F, respectively.

The bolts 92R and 92F, each of which is also normally made of metal, are headed ones which correspond to the bolt holes 76R and 76F made in beams or girders 70R and 70F, respectively. The nuts 93R and 93F, each of which is also normally made of metal, are hexagonal and the washers 94R and 94F, each of which is also normally made of metal, are square.

Figure 9:
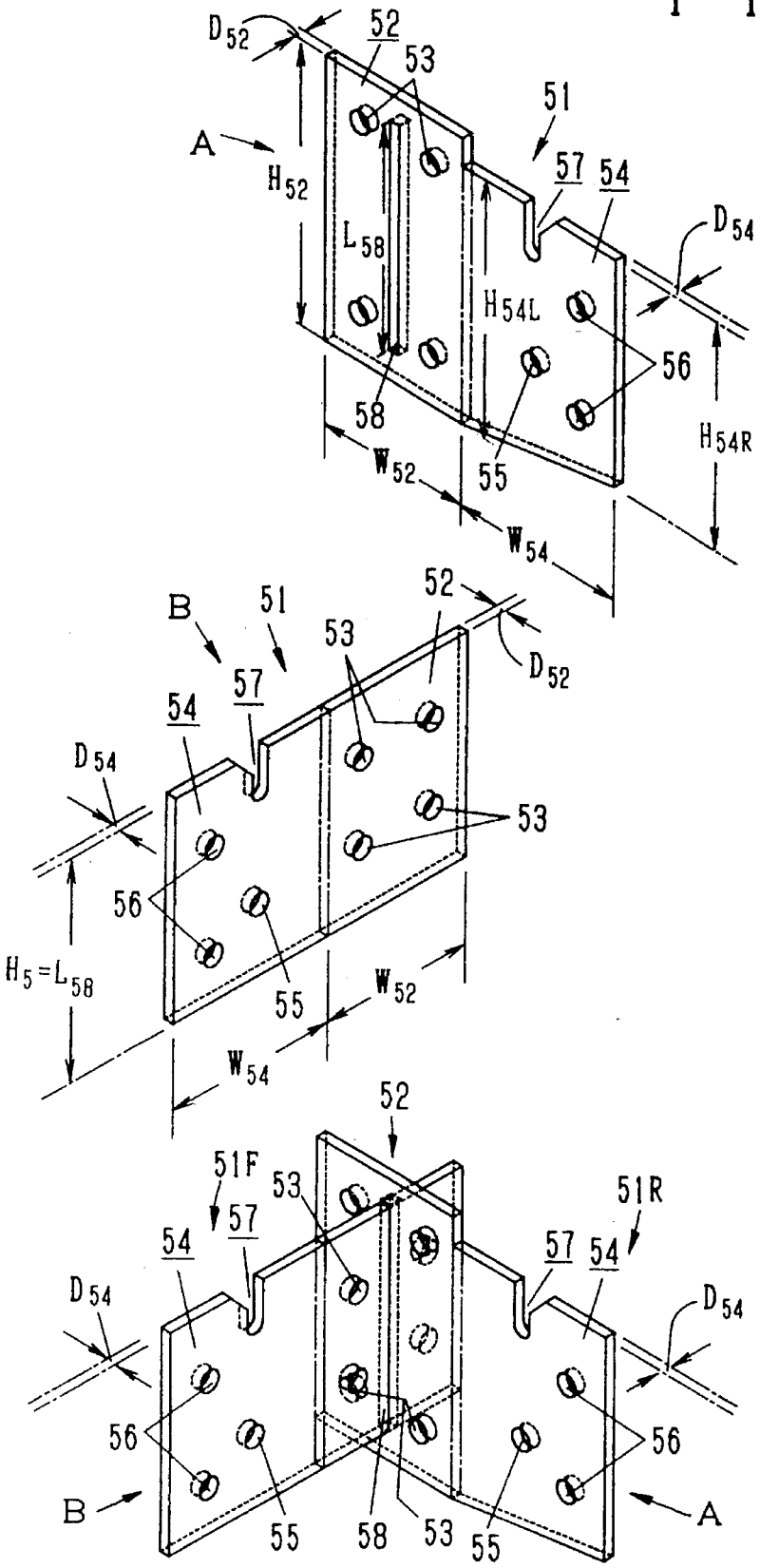
FIG. 9 shows, in perspective, the combined use of the beam or girder joint element of the first embodiment according to the present invention and a different beam or girder joint element.

As shown in FIG. 9, the column connecting plate portion 52 of the plate member 51 of the joint element B can be inserted through the slit 58 of the column connecting plate portion 52 of the joint element A; thus, the plate members 51 of the joint elements A and B can be assembled with their beam or girder connecting plate portions 54 held in perpendicularly intersecting planes.

Thus, the beams or girders 70R and 70F can be firmly fastened to the right side 60R and the front 60F of the column 60 by using the pins 81R and 81F, the pins 91R and 91F, bolts 92R and 92F, the nuts 93R and 93F and the washers 94R and 94F as described below with reference to FIGS. 10 and 11.

At first, the column connecting plate portion 52 of the plate member 51 of the joint element A is inserted into the vertical groove 61LR of the column 60 with the slit 58 of the plate portion 52 held in alignment with the vertical groove 61FB of the column 60, then the pins 81R are driven into the pin receiving holes 62FB of the column 60 through the holes 53 of the column connecting plate portion 52, whereby the plate member 51 of the joint element A is fixed to the column 60.

Next, the plate member 51 of the joint element B is inserted into the vertical groove 61FB of the column 60, by which it is automatically assembled with the plate member 51 of the joint element A fixed to the column 60 as described above in respect of FIG. 9. Then, the pins 81F are driven into the pin receiving holes 62LR of the column 60 through the holes 53 of the column connecting plate portion 52; thus, the plate member 51 of the joint element B is fixed to the column 60.

Next, the beam or girder 70R is held against the right-hand side of the column 60 so that the vertical groove 74R of the former receives the beam or girder connecting plate portion 54 of the plate member 51 of the joint element A fixed to the column 60 and that the engaging piece 77R of the beam or girder 70R is engaged with the guide groove 57 of the beam or girder connecting plate portion 54.

In this instance, the engaging piece 77R of the beam or girder 70R slides along the slope 57*a* and into engagement with the guide groove 57 of the beam or girder connecting plate portion 54 of the joint element A; hence, the beam or girder 70R is pressed against the right side 60R of the column 60, while at the same time the pin receiving hole 75R and the bolt holes 76R of the beam or girder 70R are brought into alignment with the pin receiving hole 55 and the bolt holes 56 of the beam or girder connecting plate portion 54 of the plate member 51 of the joint element A, respectively. Next, the pin 91R is driven into the pin receiving hole 75R of the beam or girder 70R across the pin receiving hole 55 of the beam or girder connecting plate portion 54 of the plate member 51 of the joint element A. Then, the bolts 92R are passed through the washers 94R and inserted into the bolt holes 76R of the beam or girder 70R across the bolt holes 56 of the beam or girder connecting plate portion 54 of the plate member 51 of the joint element A, after which the washers 74R are put on the free ends of the bolts 92R and the nuts 93R are thread-mounted thereon and tightened toward the beam or girder 70R. In this way, the beam or girder 70R is fastened to the column 60.

After or before fastening the beam or girder 70R to the right side 60R of the column 60, the beam or girder 70F is similarly fastened to the front 60F of the column 60 in such a manner as to extend in the front-to-back direction, though not described in detail.

As described above, the beams or girders 70R and 70F can be fixedly mounted to the column 60 by the combined use of the joint elements A and B.

Figure 15:
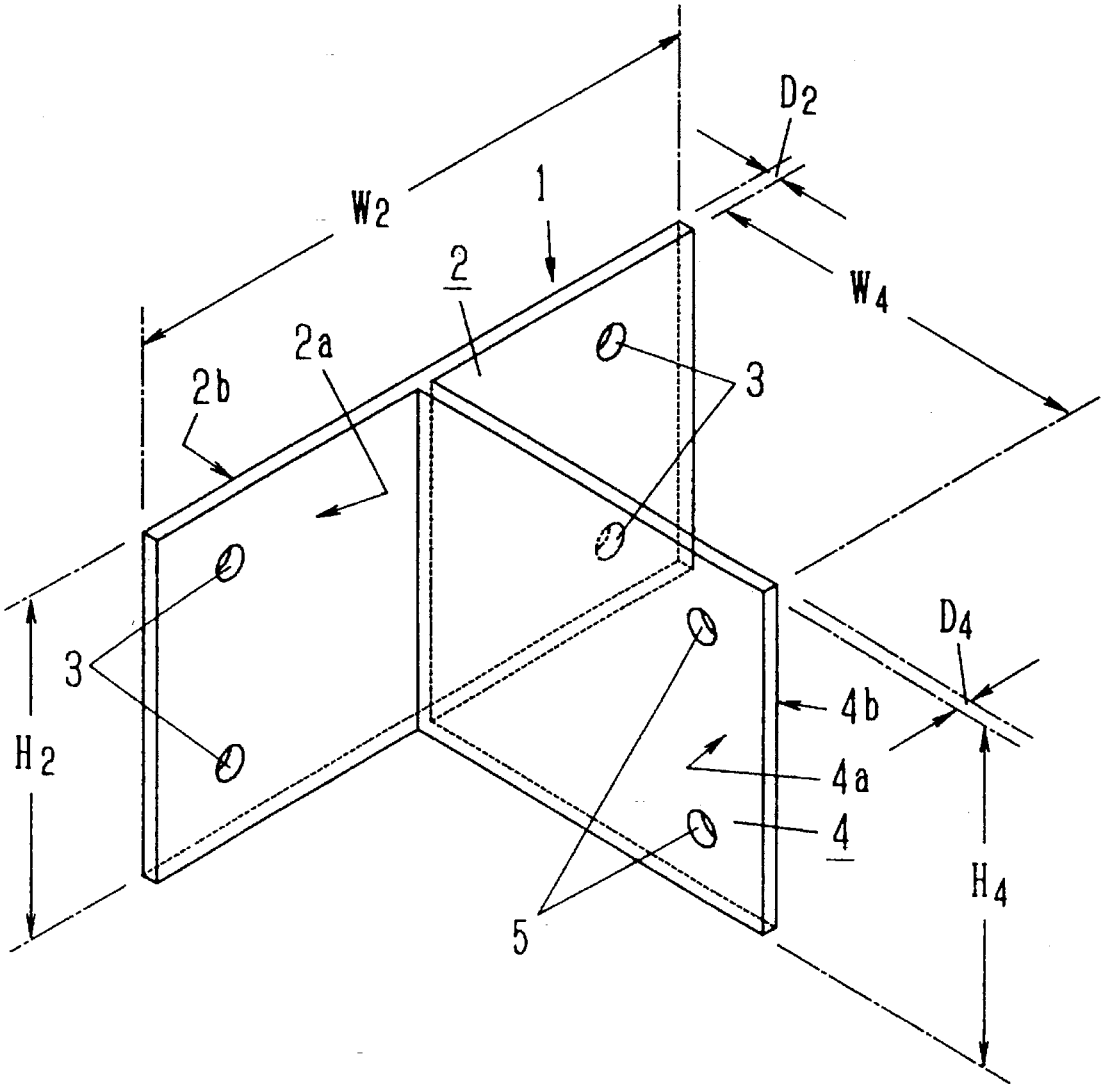
Fig. 15 PRIOR ART
FIG. 15 is a schematic perspective view showing a conventional beam or girder joint element.
Figure 16:
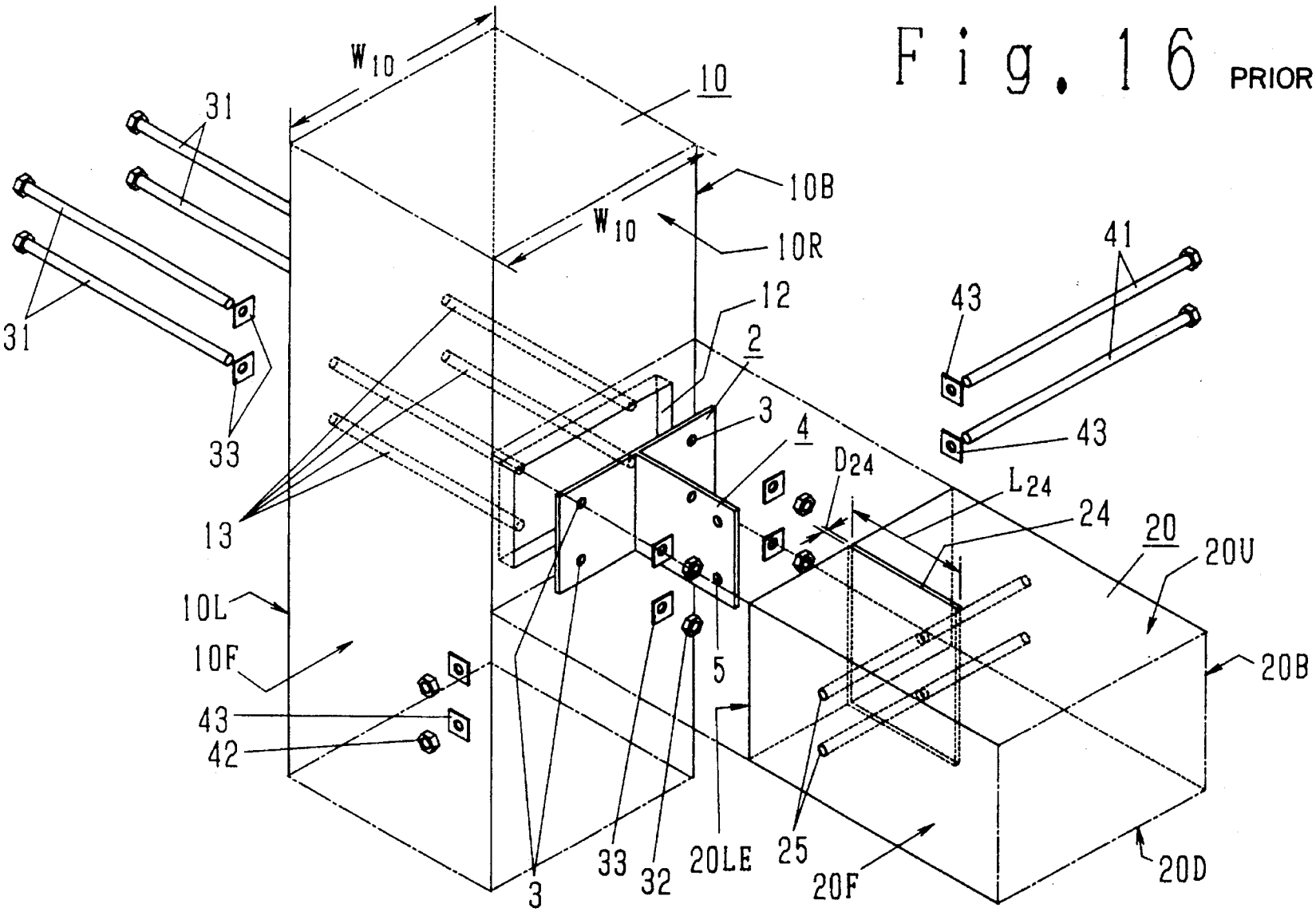
Fig. 16 PRIOR ART
FIG. 16 is an exploded perspective view showing how a beam or girder is joined to a column by use of the conventional beam or girder joint element depicted in FIG. 15.
Figure 17:
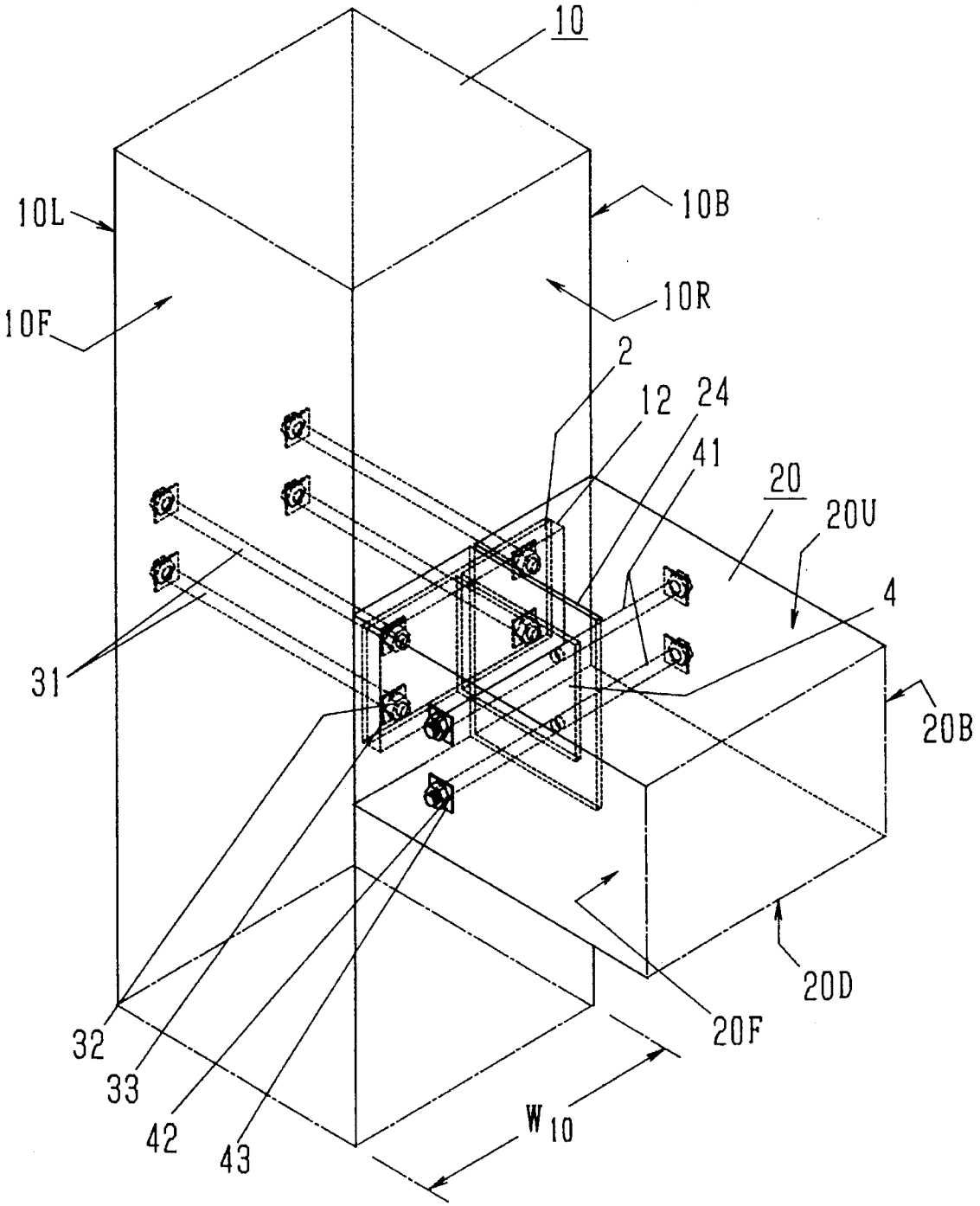
FIG. 17 is a perspective view showing the state in which the beam or girder is joined to the column by use of the conventional beam or girder joint element depicted in FIG. 15.

In the case of the joint element A according to the present invention, the plate member 51 is fixed to the column 60 by driving the pins 81R into the pin receiving holes 53 of the column connecting plate portion 52 through the pin receiving holes 62FB of the column 60 after inserting the column connecting plate portion 52 into the vertical groove 61LR of the column 60. Thus, the beam or girder joint element A can be fastened to the column 60 more firmly than the conventional beam or girder joint element described previously with respect to FIG. 15.

With the use of the beam or girder joint element of the present invention, such a wide and deep clearance groove as needed in the case of using the conventional joint element need not be formed in that side of the column 60 to which the beam or girder is fixed—this precludes the possibility of the column 60 becoming mechanically weak.

Moreover, when the beam or girder 70R is held against the right-hand side 60R of the column 60 for fixing it to the beam or girder connection plate portion 54 of the plate member 51 fixed to the column 60, the engaging piece 77R of the beam or girder 70R slides down the slope 57*a* into engagement with the guide groove 57 of the beam or girder connecting plate portion 54 of the plate member 51 fixed to the column 60; hence, the beam or girder 70R is pressed toward the column 60, with the result that the left-hand end face of the beam or girder 70R is automatically urged against the right-hand side 60R of the column 60. At this time, the beam or girder 70R is supported from below by the beam or girder connecting plate portion 54 of the plate member 51 fixed to the column 60 through the engaging piece 77R and the guide groove 57 engaging it—this allows ease in driving the pin 91R into the pin receiving holes 75R of the beam or girder 70R across the hole 55 made in the beam or girder connecting plate portion 54 of the plate member 51 of the joint element A of the present invention, in driving the bolts 92R into the bolt holes 76R of the beam or girder 70R across the holes 56 made in the beam or girder connecting plate portion 54 of the plate member 51 and in thread-mounting and tightening the nuts 93R on the free ends of the bolts 92R. Hence, the beam or girder 70R can be fastened to the column 60 with more ease than in the case of using the conventional joint element depicted in FIG. 15.

Since the beam or girder joint elements A of FIGS. 1 to 4 embodiments all have the slit 58 in the column connecting plate portion 52, their combination with the afore-mentioned another joint element B permits firmly fastening not only the beam or girder 70R to the fight side 60R of the column 60 but also the beam or girder 70F to the front 60F thereof as described above. And, in this instance, the beam or girder joint element B can also be firmly fastened to the column 60 as is the case with the joint elements A of the present invention, without the necessity of providing the clearance groove in the column 60 and hence without reduction of its strength. Furthermore, the beam or girder 70F can easily be fastened to the column 60 as is the case with the beam or girder joint elements A of the present invention.

EMBODIMENTS 5 TO 8

FIGS. 5 to 8 illustrate fifth to eighth embodiments of the present invention, in which the pans corresponding to those in FIGS. 1 to 4 are identified by the same reference numerals.

The fifth to eighth embodiments of FIGS. 5 to 8 are identical in construction with the first to fourth embodiments of FIGS. 1 to 4 except that the plate member 51 of each of the beam or girder joint elements of the former is composed of the same column connecting plate portion 52 as those of the latter and right- and left-hand beam or girder connecting plate portions 54R and 54L formed as unitary structures with the column connecting plate portion 52 on the both sides thereof symmetrically with respect thereto. The right-hand beam or girder connecting plate portion 54R is identical in construction with that 54 and hence has a pin receiving hole 55R, bolt holes 56R and a guide groove 57R corresponding to those mentioned above, respectively. The left-hand beam or girder connecting plate portion 54L has a pin receiving hole 55L, bolt holes 56L and a guide groove 57L identical with those of the right-hand beam or girder connecting plate portion 54R.

Figure 12:
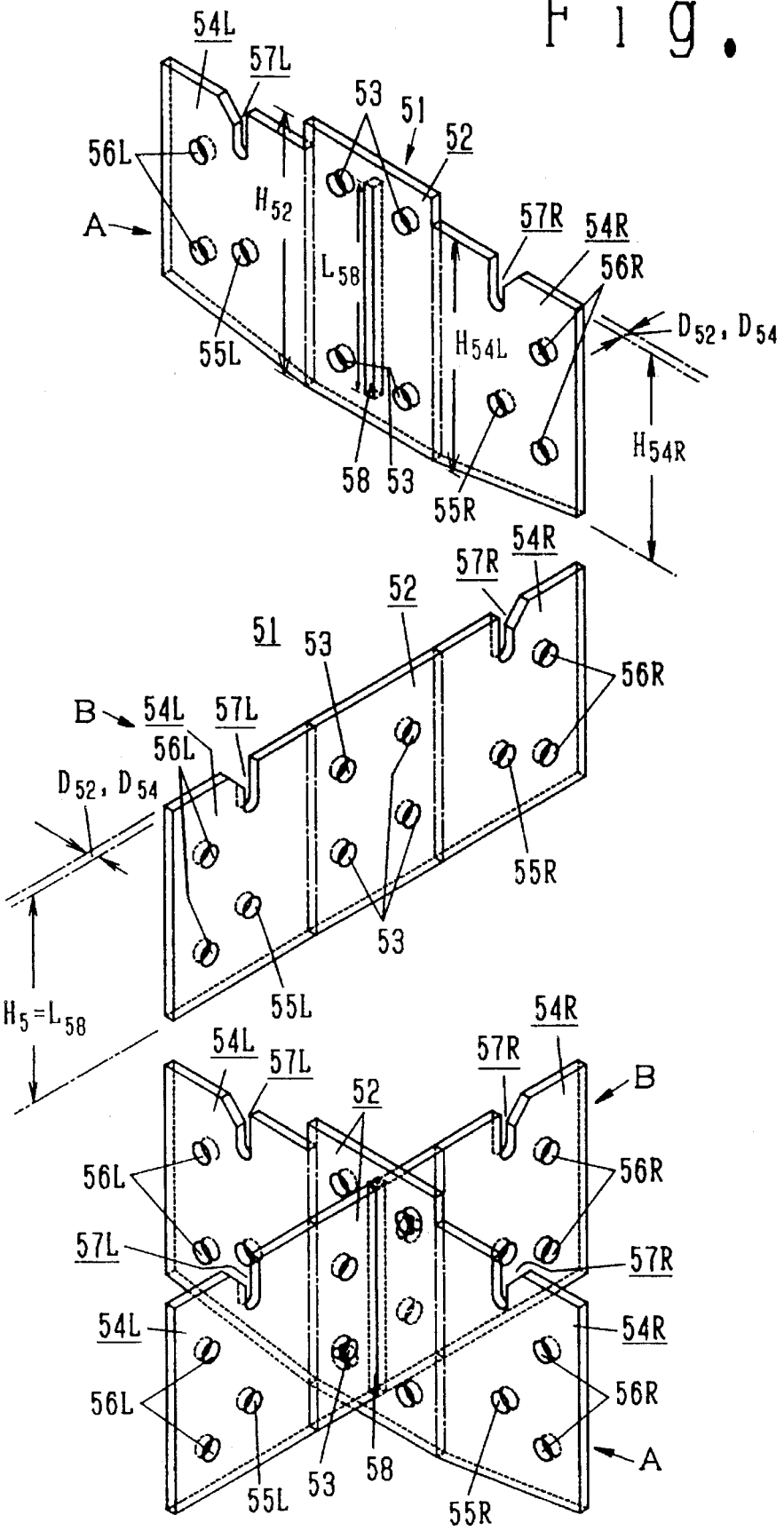
FIG. 12 shows, in perspective, the combined use of the beam or girder joint element of the fifth embodiment according to the present invention and a different beam or girder joint element.

Since the beam or girder joint elements of the fifth to eighth embodiments of the present invention each have such a construction as described above, they can each be assembled with another beam or girder joint element B shown in FIG. 12. The beam or girder joint element B shown in FIG. 12 has the same column connecting plate portion 53 and right and left beam or girder connecting plate portions 54R and 54L. The right beam or girder connecting plate portion 54R is identical in configuration with the plate portion 54 of the joint element B shown in FIG. 9 and the corresponding parts are identified by the same reference numerals added with a suffix "R". The left and right beam or girder connecting plate portions 54L and 54R are symmetric with respect to the column connecting plate portion 52; the parts of the plate portion 54L corresponding to those of the right plate portion 54R are identified by the same reference numerals added with a suffix "L". In FIG. 12, the beam or girder joint element of the FIG. 5 embodiment is shown to be used in combination with the joint element B depicted in FIG. 12; they can be assembled with the plate portion 54L of the joint element A and the plate portions 54R and 54L of the joint element B held in perpendicularly intersecting planes and with the plate portion 54R of the element A and the plate portions 54L and 54R of the element B held perpendicular to each other.

Figure 10:
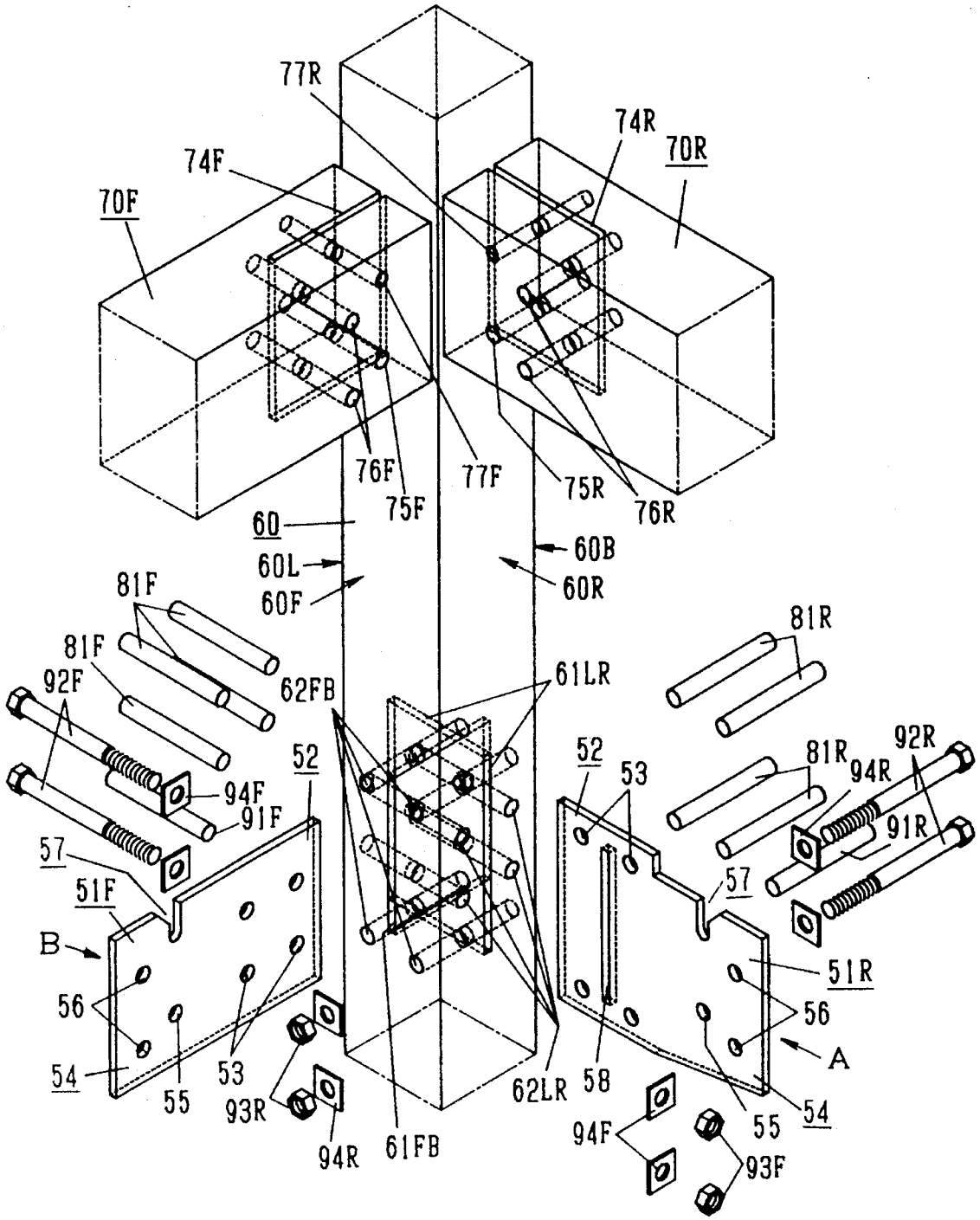
FIG. 10 is an exploded perspective view showing how a beam or girder is joined to a column by use of the beam or girder joint element of the first embodiment according to the present invention.
Figure 11:
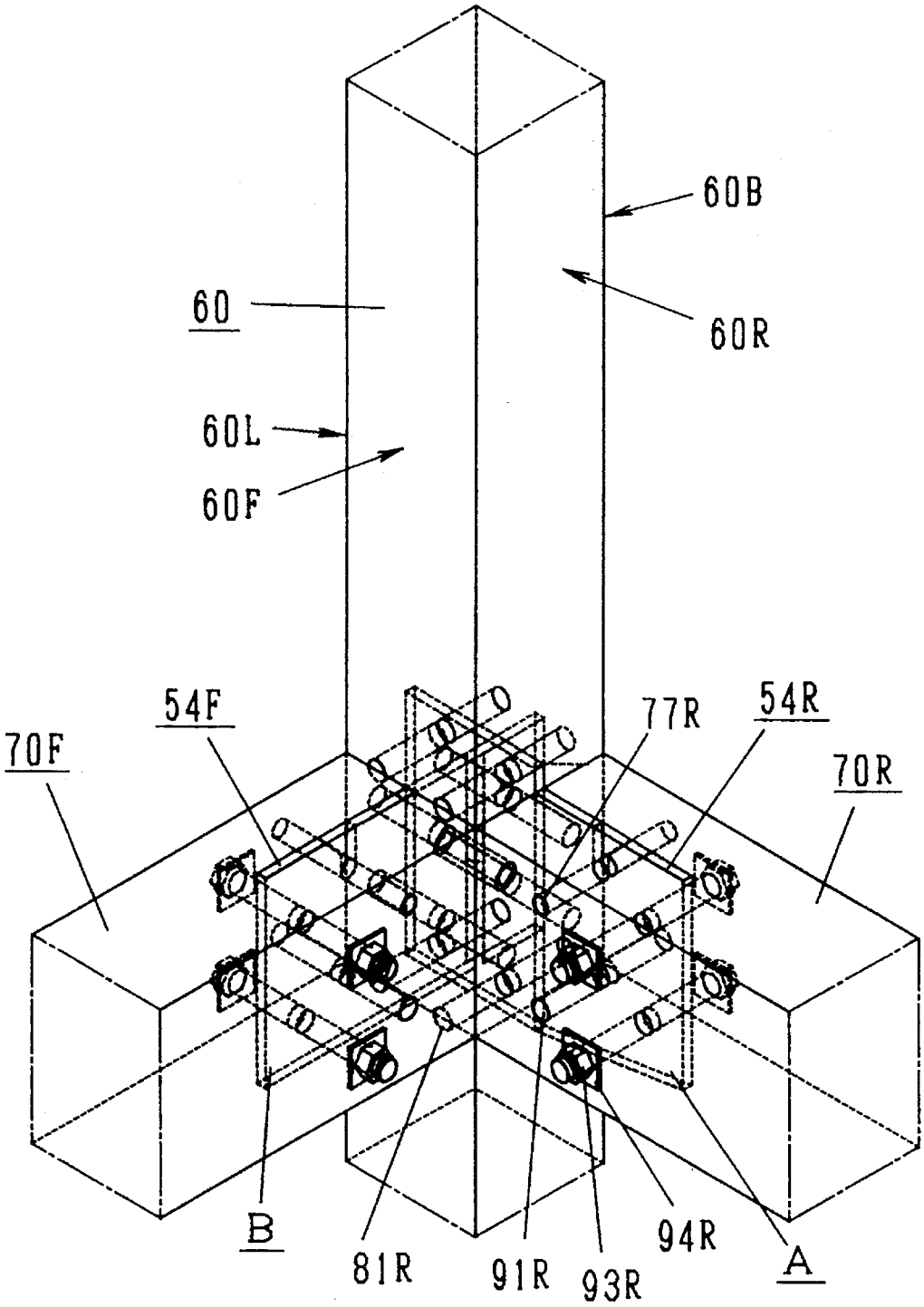
FIG. 11 is a perspective view showing the state in which the beam or girder is joined to the column by the use of the beam or girder of the first embodiment according to the present invention.
Figure 13:
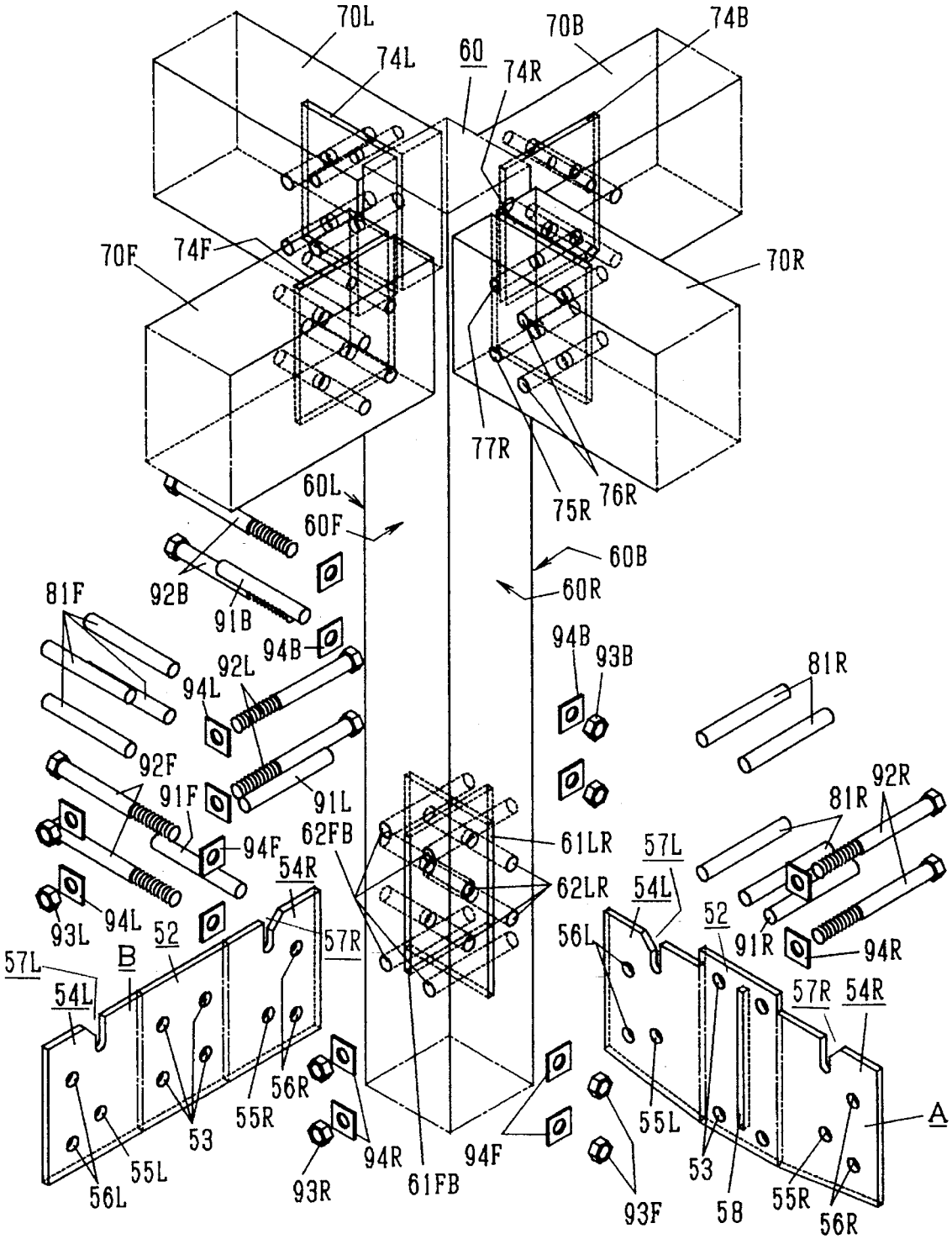
FIG. 13 is an exploded perspective view showing how a beam or girder is joined by a column by use of the beam or girder joint element of the fifth embodiment according to the present invention.
Figure 14:
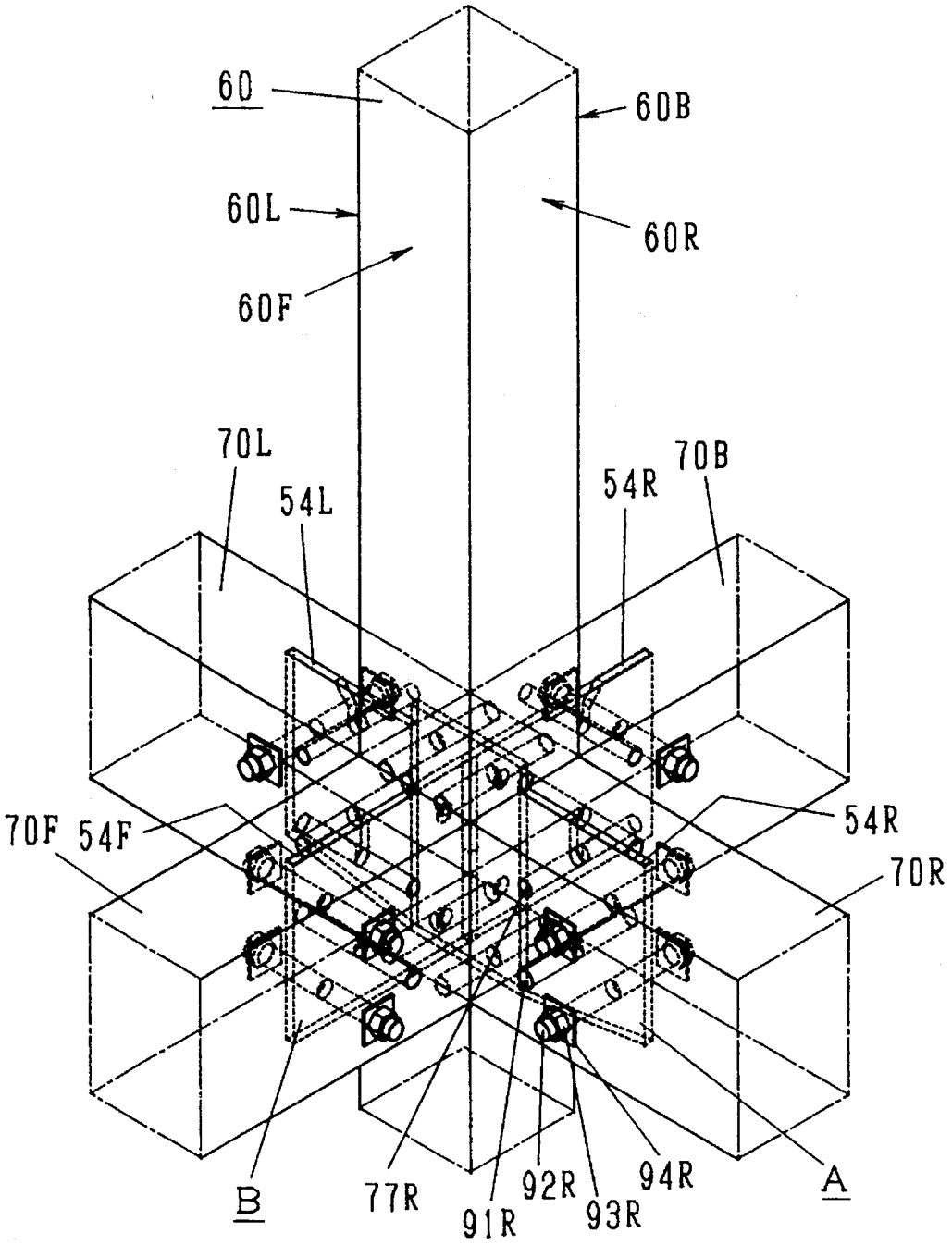
FIG. 14 is a perspective view showing the state in which the beam or girder is joined to the column by use of the beam or girder joint element of the fifth embodiment according to the present invention.

Thus, as shown in FIGS. 13 and 14, beams or girders 70R and 70F similar to those depicted in FIGS. 10 and 11 can be fastened to the right side 60R and the front 60F of a column 60 similar to that shown in FIGS. 10 and 11. Likewise, beams or girders 70L and 70B similar to the above-mentioned can be fastened to the let side 60L and the back 60B of the column 60 as depicted in FIGS. 13 and 14. In FIGS. 13 and 14, the parts corresponding to those in FIGS. 10 and 11 are identified by the same reference numerals. Reference numerals 74L and 74B denote vertical grooves of the beam or girder 70L and 70B, respectively. Reference numerals 91L, 92L, 93L and 94L denote a pin, bolts, nuts and washers for joining the beam or girder 70L to the column 60. Reference numerals 91B, 92B, 93B and 94B denote a pin, bolts, nuts and washers for joining the beam or girder 70B to the column 60. In this instance, the same effects as described previously with respect to FIGS. 10 and 11 can also be obtained.

Figure 5:
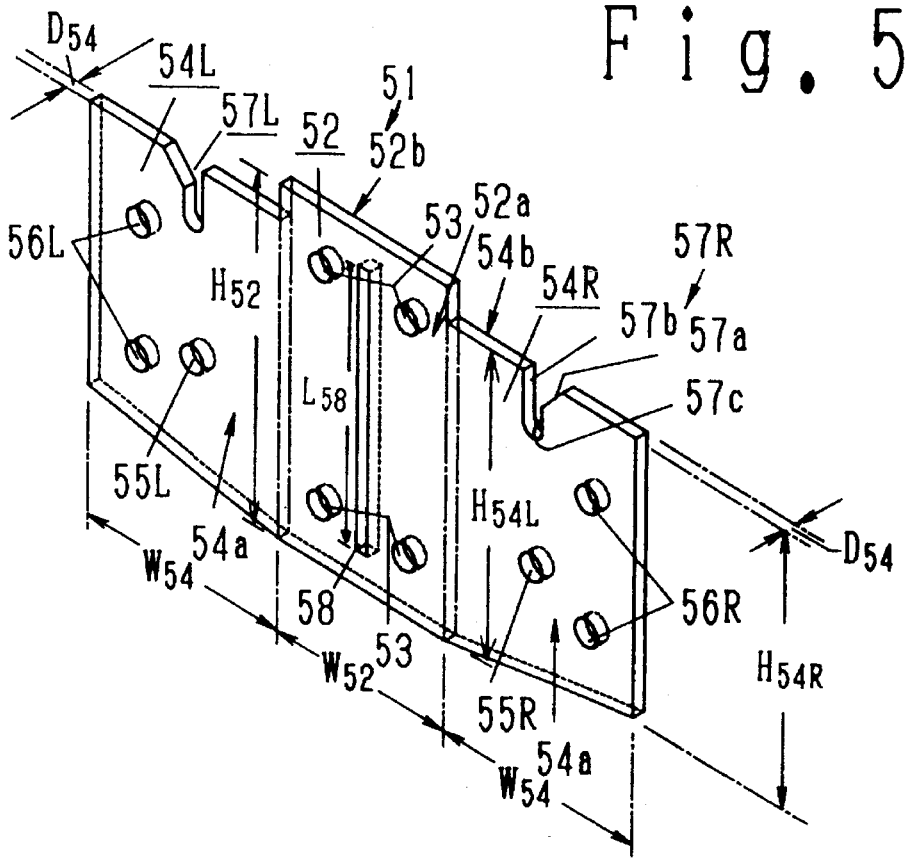
FIG. 5 is a schematic perspective view illustrating a fifth embodiment of the beam or girder joint element according to the present invention.
Figure 6:
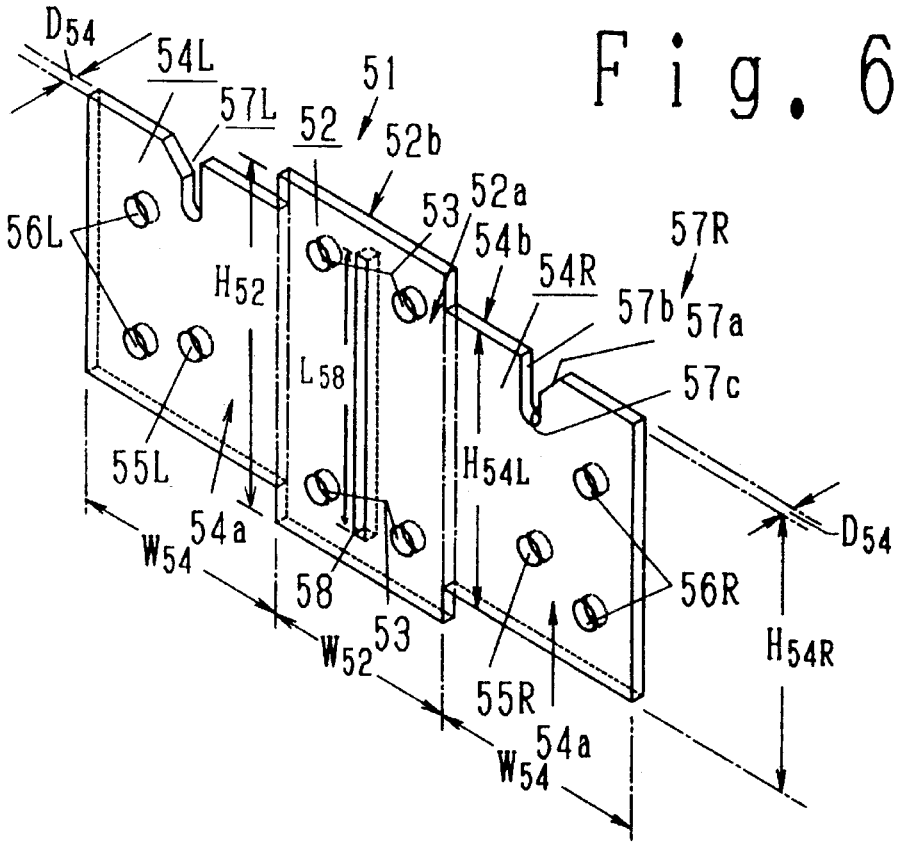
FIG. 6 is a schematic perspective view illustrating a sixth embodiment of the present invention.
Figure 7:
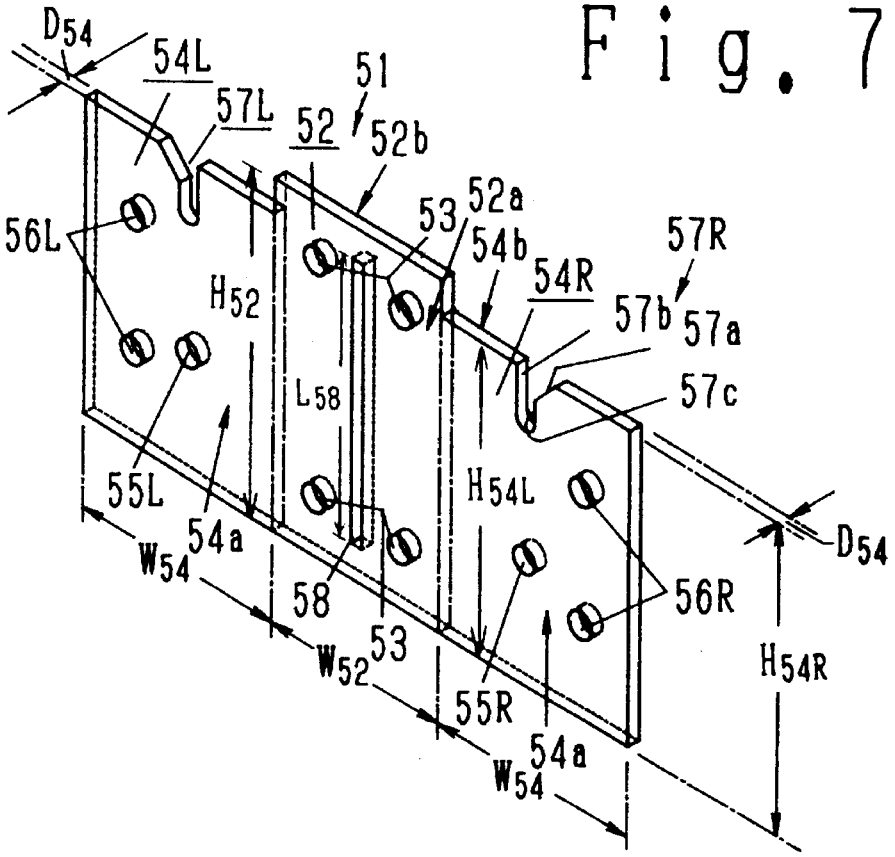
FIG. 7 is a schematic perspective view illustrating a seventh embodiment of the beam or girder joint element according to the present invention.
Figure 8:
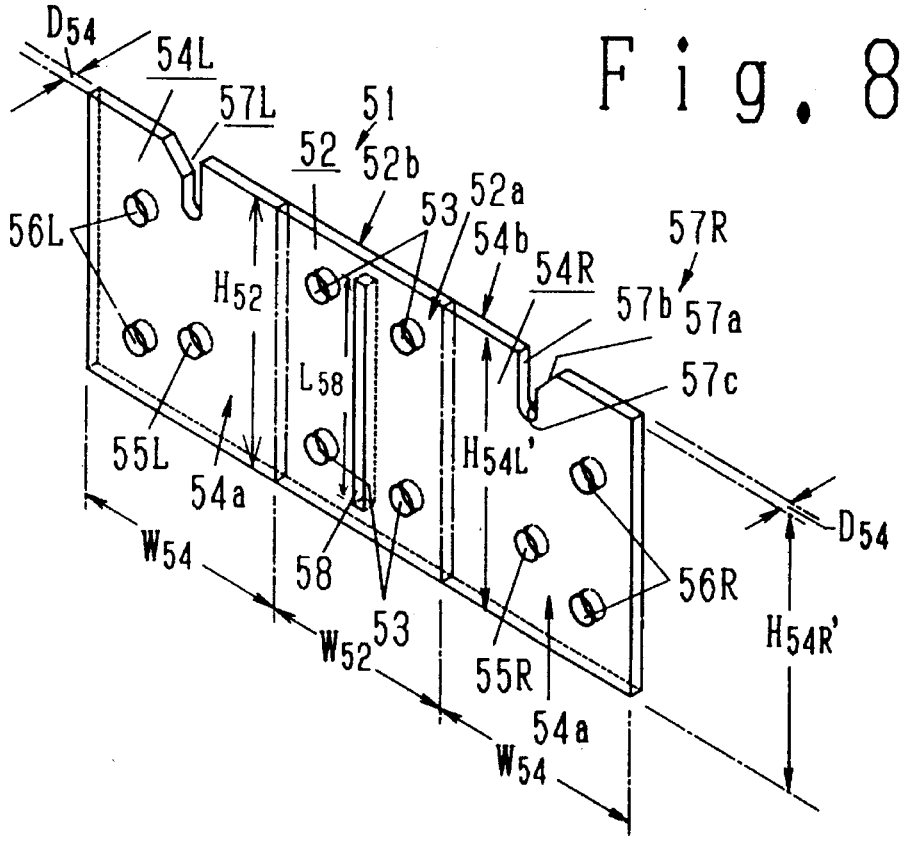
FIG. 8 is a schematic perspective view illustrating an eighth embodiment of the beam or girder joint element according to the present invention.

While the above description has been given of the combined use of the beam or girder joint element of the FIG. 1 embodiment and the joint element B shown in FIG. 9 and the combined use of the beam or girder joint element of the FIG. 5 embodiment and the joint element B shown in FIG. 12, it is evident that the beam or girder joint elements of the FIGS. 2 to 4 can each used in combination with the joint element B depicted in FIG. 9 and that the joint elements shown in FIGS. 6 to 8 can also be used in combination with the joint element B depicted in FIG. 12. Furthermore, it is apparent that the beam or girder joint elements of FIGS. 1 to 4 embodiments can each be combined with the joint element B shown in FIG. 12 and that the joint elements shown in FIGS. 5 to 9 can also be combined with the joint element B depicted in FIG. 9.

It will be apparent that many modifications and variations may be effected without departing from the scope of the novel concepts of the present invention.

What is claimed is:

1. A beam or girder joint element formed by a flat plate member which comprises: (a) a square column connecting plate portion which has a plurality of pin receiving through holes and a vertically extending slit; and (b) a beam or girder connecting plate portion which is formed as a unitary structure with the column connecting plate portion and extended therefrom along its right- or left-hand marginal edge and has a pin receiving through hole, a plurality of bolt holes and a V-shaped guide groove defined by a slope extending down from the upper edge of the beam or girder connecting plate portion toward the column connecting plate portion and a vertical edge opposite to the slope.

2. The beam or girder joint element of claim 1, wherein the column connecting plate portion of the plate member is longer than the beam or girder connecting plate portion in the vertical direction and the slit of the column connecting plate portion has a length nearly equal to the left- or right-hand end face of the beam or girder connecting plate portion.

3. The beam or girder joint element of claim 1, wherein the column connecting plate portion of the plate member has the same vertical length as does the beam or girder connecting plate portion.

4. A beam or girder element formed by a plate member which comprises: (a) a square column connecting plate portion which has a plurality of pin receiving through holes and a vertically extending slit; (b) a left beam or girder connecting plate portion which is formed as a unitary structure with the column connecting plate portion and extended therefrom along its left-hand marginal edge and has a pin receiving through hole, a plurality of bolt holes and a V-shaped left guide groove defined by a slope extending down from the upper edge of the left beam or girder connecting plate portion toward the column connecting plate portion and a vertical edge opposite to the slope; and (c) a fight beam or girder connecting plate portion which is formed as a unitary structure with the column connecting plate portion and extended therefrom along its right-hand marginal edge and has a pin receiving through hole, a plurality of bolt holes and a V-shaped right guide groove defined by a slope extending down from the upper edge of the right beam or girder connecting plate portion and a vertical edge opposite to the slope.

5. The beam or girder joint element of claim 4, wherein the column connecting plate portion of the plate member is longer than the left and right beam or girder connecting plate members in the vertical direction; the left and right beam or girder connecting plate portions are symmetrical with respect to the column connecting plate portion; and the slit of the column connecting plate portion has a length substantially equal to the length of the left-hand end face of the let beam or girder connecting plate portion and the length of the right-hand end face of the right beam or girder connecting plate portion.

6. The beam or girder joint element of claim 4, wherein the column connecting plate portion of the plate member has a vertical length equal to those of the let and right beam or girder connecting plate portions; the left and right beam or girder connecting plate portions are symmetrical with respect to the column connecting plate portion.

* * * * *